US010132580B1

(12) United States Patent
Kincel et al.

(10) Patent No.: US 10,132,580 B1
(45) Date of Patent: Nov. 20, 2018

(54) FORWARD ASSIST ASSEMBLY

(71) Applicant: BRAVO COMPANY MFG., INC., Hartland, WI (US)

(72) Inventors: Eric S. Kincel, Coeur d'Alene, ID (US); Jeffrey J. O'Brien, Coeur d'Alene, ID (US)

(73) Assignee: Bravo Company MFG, Inc., Hartland, WI (US)

( * ) Notice: Subject to any disclaimer, the term of this patent is extended or adjusted under 35 U.S.C. 154(b) by 0 days.

(21) Appl. No.: 15/953,231

(22) Filed: Apr. 13, 2018

(51) Int. Cl.
*F41A 3/72* (2006.01)
*F41A 7/02* (2006.01)

(52) U.S. Cl.
CPC . *F41A 3/72* (2013.01); *F41A 7/02* (2013.01)

(58) Field of Classification Search
CPC ..... F41A 3/72; F41A 19/00
USPC ..... 42/69.01, 69.02; 89/1.4
See application file for complete search history.

(56) References Cited

U.S. PATENT DOCUMENTS 7,798,045 B1 * 9/2010 Fitzpatrick ..... F41A 21/481 42/69.02
8,590,199 B2 11/2013 Overstreet et al.
8,826,797 B2 9/2014 Overstreet et al.
8,910,406 B1 12/2014 Huang et al.
D759,780 S 6/2016 Wang
9,551,545 B1 * 1/2017 Rowe ..... F41A 19/06
2017/0191770 A1 * 7/2017 Stewart ..... F41A 3/72

* cited by examiner

*Primary Examiner* — J. Woodrow Eldred
(74) *Attorney, Agent, or Firm* — Michael Best & Friedrich LLP

(57) ABSTRACT

A forward assist assembly movable between a standby position and an engaged position in a forward assist bore of a firearm. The assembly includes a button and an single-piece pawl. The single-piece pawl includes an integrally-formed pivot boss supporting the pawl in the button for pivotal movement with respect to the button. The pivot boss also transfers a linear actuation force from the button to the pawl to move the assembly into the engaged position. The single-piece pawl also includes an integrally-formed finger having an engagement surface for engaging a ratchet tooth on the bolt carrier in the engaged position. The single-piece pawl also includes an integrally-formed retaining surface to retain the forward assist assembly in the standby position in the forward assist bore. The single-piece pawl also includes an integrally-formed stop surface to abut a portion of the button in the standby position. The forward assist assembly also includes a return spring for biasing the button and pawl toward the standby position. The single-piece pawl also includes an integrally-formed biasing member seat receiving an end of the return spring.

23 Claims, 9 Drawing Sheets

FORWARD ASSIST ASSEMBLY

BACKGROUND

The present invention relates to a forward assist assembly for a firearm.

SUMMARY

The present invention provides a forward assist assembly for use with an upper receiver assembly of a firearm or an upper receiver including such a forward assist assembly. The upper receiver assembly includes a chamber, a forward assist bore communicating with the chamber, and a bolt carrier group within the chamber. The bolt carrier group includes a bolt carrier having at least one external ratchet tooth accessible through the forward assist bore. The forward assist assembly is adapted to be received in the forward assist bore. The forward assist assembly comprises a button having an integrally-formed pivot seat; a single-piece pawl including an integrally-formed engagement surface; and a pivot boss received in the pivot seat and supporting the pawl, the pivot boss defining a pivot axis about which the pawl pivots with respect to the button. In one aspect of the invention, linear actuation of the button in the forward assist bore is transferred to the pawl through the interaction of the pivot seat and pivot boss to bring the engagement surface into engagement with the ratchet tooth. Continued linear actuation of the button, after engagement of the ratchet tooth, urges the bolt carrier in a forward direction in the chamber as the pawl pivots about the pivot axis, to maintain engagement of the engagement surface with the ratchet tooth.

In one aspect of the invention, the pivot seat comprises an open channel in the button. In another aspect of the invention, the pivot boss is integrally formed with the pawl. In another aspect of the invention, the pivot boss is defined by a pin extending through the pawl. In another aspect of the invention, the single-piece pawl further includes an integrally-formed biasing seat, the forward assist assembly further comprising: a biasing member bearing against the biasing seat to apply a biasing force to the button and pawl toward a standby position in the forward assist bore. In another aspect of the invention, the biasing force acts on a line offset from and transverse to the pivot axis to impart a moment to the pawl about the pivot axis with respect to the button. In another aspect of the invention, the biasing member includes a compression spring having a spring coil; and the integrally-formed biasing seat comprises a raised portion extending into the spring coil. In another aspect of the invention, the single-piece pawl further includes an integrally-formed stop surface which engages a pawl bearing surface of the button to limit a pivoting range of motion of the pawl with respect to the button. In another aspect of the invention, the single-piece pawl further includes an integrally-formed retaining surface engaging a portion of the forward assist bore to resist removal of the forward assist assembly from the forward assist bore. In another aspect of the invention, the single-piece pawl further includes a release lever for manually pivoting the pawl entirely within the envelope of the button for removal of the forward assist assembly from the forward assist bore. In another aspect of the invention, the button includes a release slot and an engagement slot; the single-piece pawl includes an integrally-formed release lever extending through the release slot and an integrally-formed finger extending through the engagement slot and defining the engagement surface; and the pawl is pivotable with respect to the button about the pivot axis to position both the release lever and finger within the envelope of the button to facilitate removal of the forward assist assembly from the forward assist bore. In another aspect of the invention, the button includes an button bore and wherein the release slot and engagement slot are on opposite sides of the button bore.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
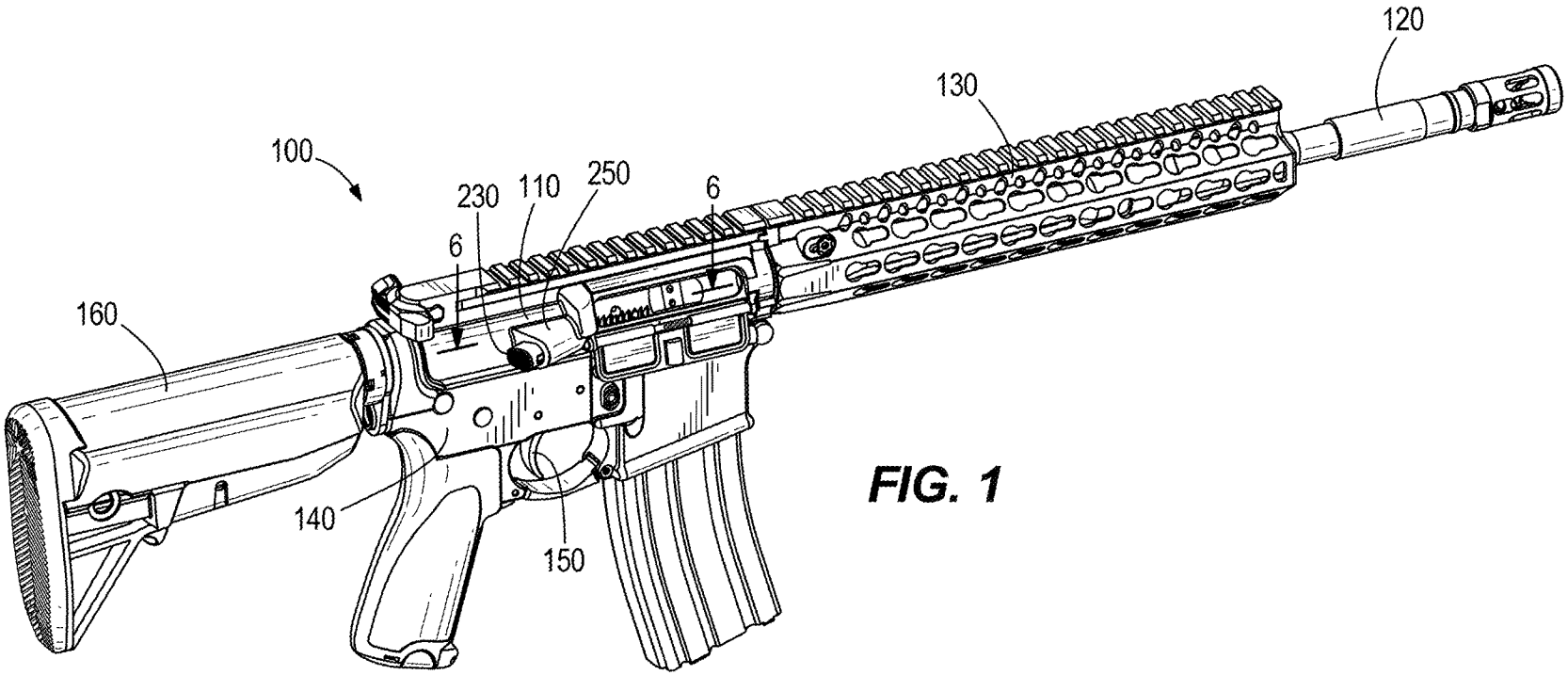
FIG. 1 illustrates an exemplary firearm including an embodiment of the present invention.

FIG. 1 illustrates an exemplary firearm 100 which may embody the present invention. The illustrated firearm 100 is an AR-15 rifle and includes an upper receiver assembly 110 to which a barrel 120, hand guard 130, lower receiver 140 including a trigger assembly 150, and butt stock 160 are mounted. The components are generally conventional, except the upper receiver assembly 110 which will be described in more detail below.

Figure 2:
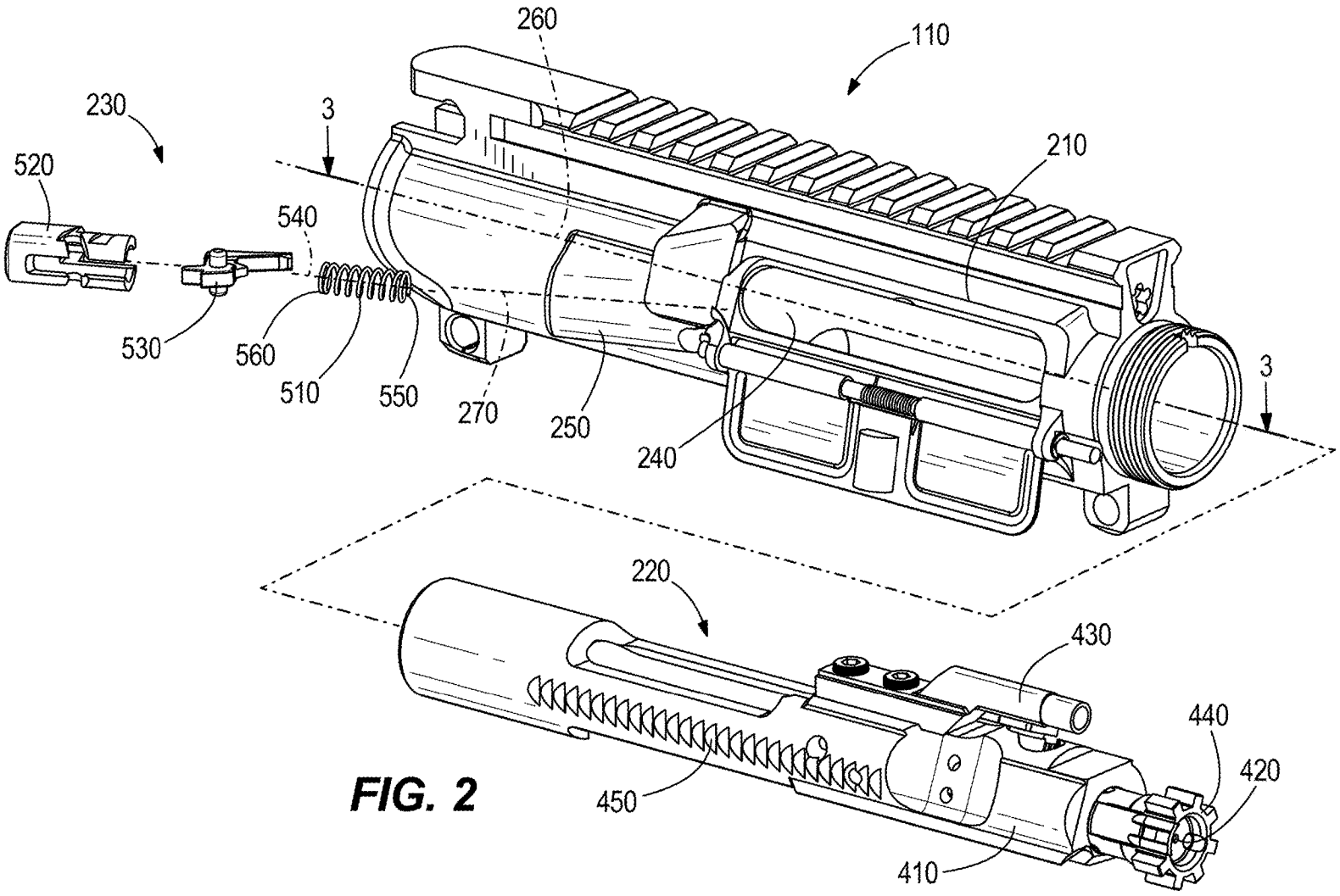
FIG. 2 is an exploded view of an upper receiver assembly of the firearm.
Figure 3:
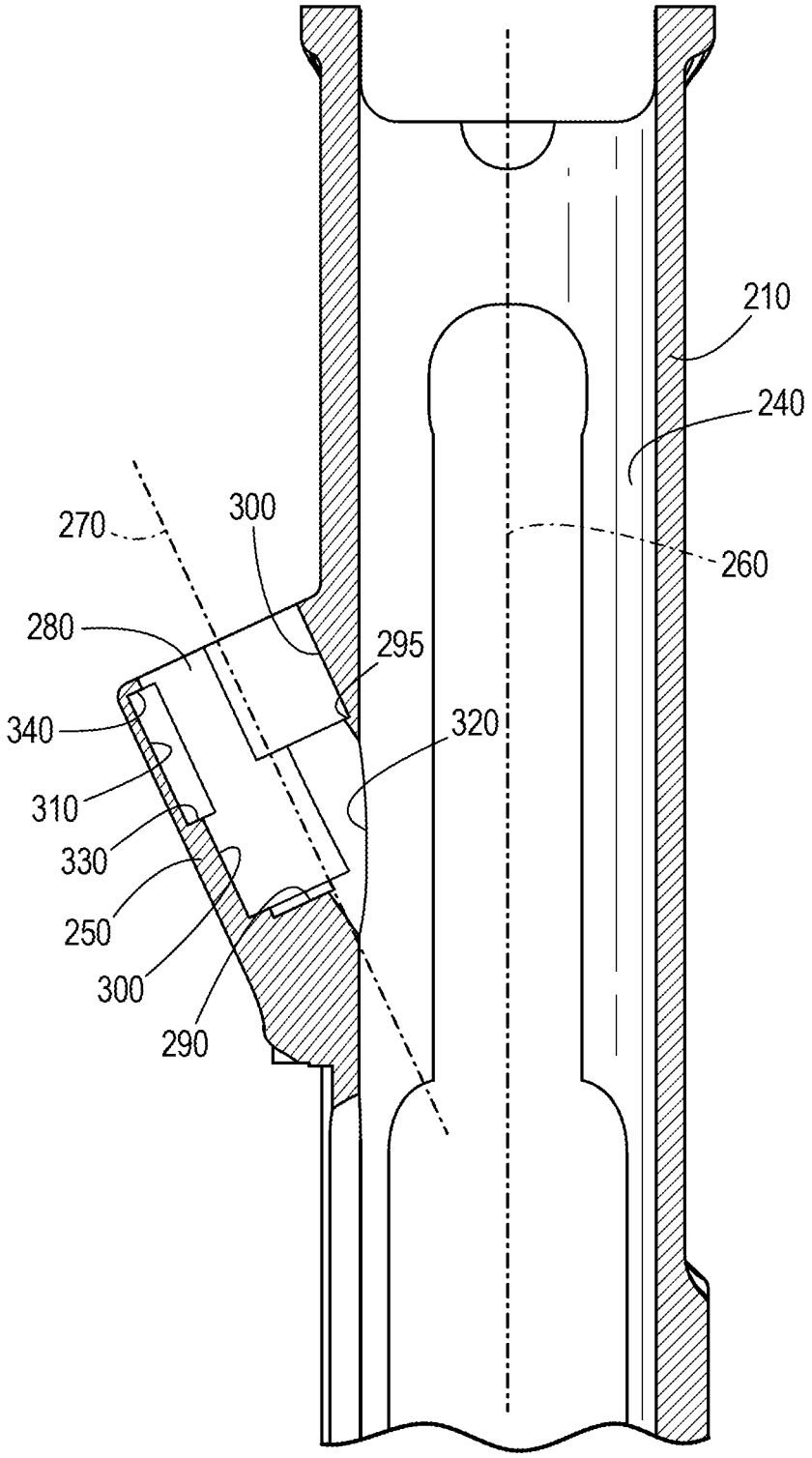
FIG. 3 is a cross-sectional view from section line 3-3 in FIG. 2 of an upper receiver housing of the upper receiver assembly.

Referring to FIGS. 2 and 3, the upper receiver assembly 110 includes an upper receiver housing 210 that supports a bolt carrier group 220 and a forward assist assembly 230, among other components. The upper receiver housing 210 defines a chamber 240 into which the bolt carrier group 220 is installed and a forward assist bore 250 into which the forward assist assembly 230 is installed. The chamber 240 defines a main axis 260 (i.e., a longitudinal axis of the chamber 240) and the forward assist bore 250 defines a forward assist axis 270 (i.e., the longitudinal axis of the forward assist bore 250). The main axis 260 and forward assist axis 270 are at a non-zero acute angle with respect to each other (e.g., in the range of 25°-40° or 30°-35°). The main axis 260 is collinear with the axis of the barrel 120 and is the axis along which the bolt carrier group 220 reciprocates in the chamber 240.

The forward assist bore 250 includes a mouth 280, a biasing member bearing surface 290, guide surfaces 300 inside the bore 250, a button stop 295, a clearance section 310, and an access window 320. A portion of the forward assist assembly 230 extends out of the mouth 280 of the forward assist bore 250. The guide surfaces 300 are smooth to facilitate reliable reciprocation and smooth action of the forward assist assembly 230 in the forward assist bore 250. The guide surfaces 300 are shaped to receive the components of the forward assist assembly 230 for smooth action of the forward assist assembly 230 in the forward assist bore 250. The access window 320 communicates between the chamber 240 and the forward assist bore 250. The biasing member bearing surface 290 is perpendicular to the forward assist axis 270. The button stop 295 is a shoulder on the inner surface of the forward assist bore 250. The clearance section 310 is a widened portion of the forward assist bore 250, resulting in a shoulder 330 at the transition between the guide surface 300 and the clearance section 310, and a retention undercut 340 between the clearance section 310 and the mouth 280. The purposes of these various surfaces of the forward assist bore 250 will be explained in more detail below.

The bolt carrier group 220 is conventional and includes a bolt carrier 410 that supports a firing pin 420, a gas key 430, and a bolt assembly 440 among other components. A round is properly positioned in the chamber 240 for firing (i.e., the round is properly "chambered") when the bolt carrier group 220 is moved fully forward and the bolt assembly 440 is locked in place. The bolt carrier group 220 can be said to be in a ready-to-fire position when a round is property chambered. With the round properly chambered, the firing pin 420 is actuated by the trigger assembly 150 to fire the properly-chambered round out the barrel 120. During ordinary operation of the firearm 100, high-pressure gases are returned from the barrel 120 to the chamber 240 via the gas key 430. The pressure of the returned high-pressure gases moves the bolt carrier group 220 rearward and ejects the spent round casing. A new round is automatically fed into the chamber 240 and the bolt carrier group 220 again moves forward into the ready-to-fire position.

There are circumstances, however, under which the bolt carrier group 220 fails to achieve the ready-to-fire position. Such circumstances include when there is high friction between the chamber 240 and the bolt carrier 410 (e.g., due to dirt or residue in the chamber 240), when the firearm operator rides the charging handle down when loading a round, and when the firearm operator wishes to silently move the bolt carrier group 220 into the ready-to-fire position. In such circumstances, the forward assist assembly 230 is used to manually move the bolt carrier group 220 into the ready-to-fire position. For this purpose, the bolt carrier 410 includes a plurality of forward assist ratchet teeth 450 along a side that is accessible through the forward assist bore 250.

The illustrated forward assist assembly 230 includes a return spring 510, a button 520, and a pawl 530. As will be discussed in more detail below, the forward assist assembly 230 is biased into a standby position illustrated in FIG. 6 and can be manually actuated into an engaged position illustrated in FIG. 7. The terms "standby position" and "engaged position" will be used throughout this disclosure to describe positions of the forward assist assembly 230 as a whole and relative positions of each individual component of the forward assist assembly 230 corresponding to FIGS. 6 and 7.

The illustrated return spring 510 comprises a compression spring having a plurality of coils around a spring axis 540 and including a first end 550 that engages the biasing member bearing surface 290 in the forward assist bore 250 and a second end 560 that engages the pawl 530 as will be described. In other embodiments of the invention, the return spring 510 may take the form of a tension spring, a torsion spring, or any other suitable biasing member which has sufficient resilience to return the forward assist assembly 230 to the standby position (FIG. 6) after it has been manually actuated to the engaged position (FIG. 7). In this regard, the illustrated return spring 510 may be referred to more generically as a biasing member to encompass the illustrated compression spring and any other biasing members.

When the forward assist assembly 230 is installed into the forward assist bore 250, the spring axis 540 is parallel to but not collinear with the forward assist axis 270. The return spring 510 provides a biasing force collinear with the spring axis 540 and along the forward assist axis 270 toward the standby position. For the purposes of this disclosure, a force or direction is "along" an axis if it is parallel to or collinear with the axis.

Figure 4:
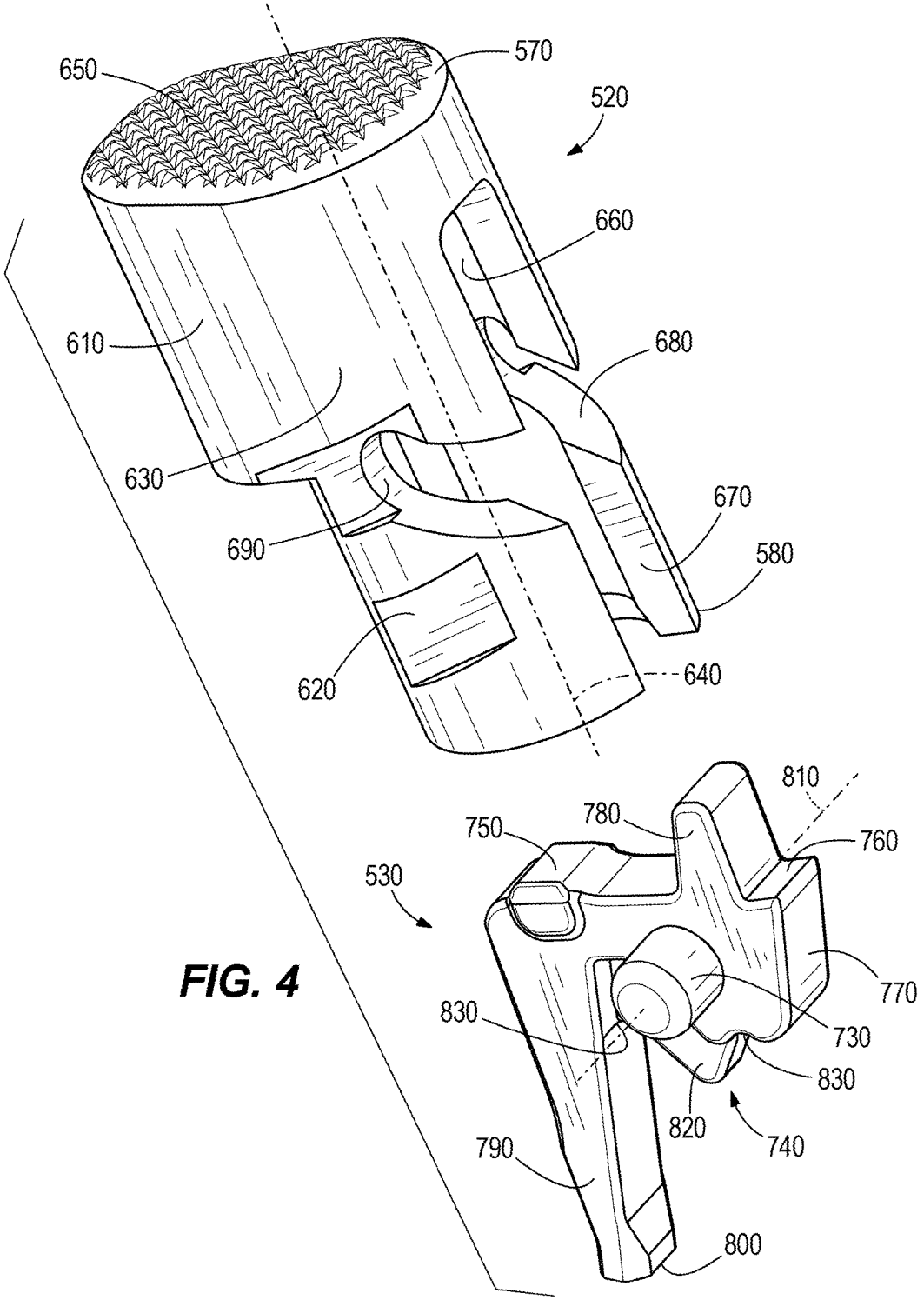
FIG. 4 is a perspective view of a button and pawl of a forward assist assembly from a first angle.
Figure 5:
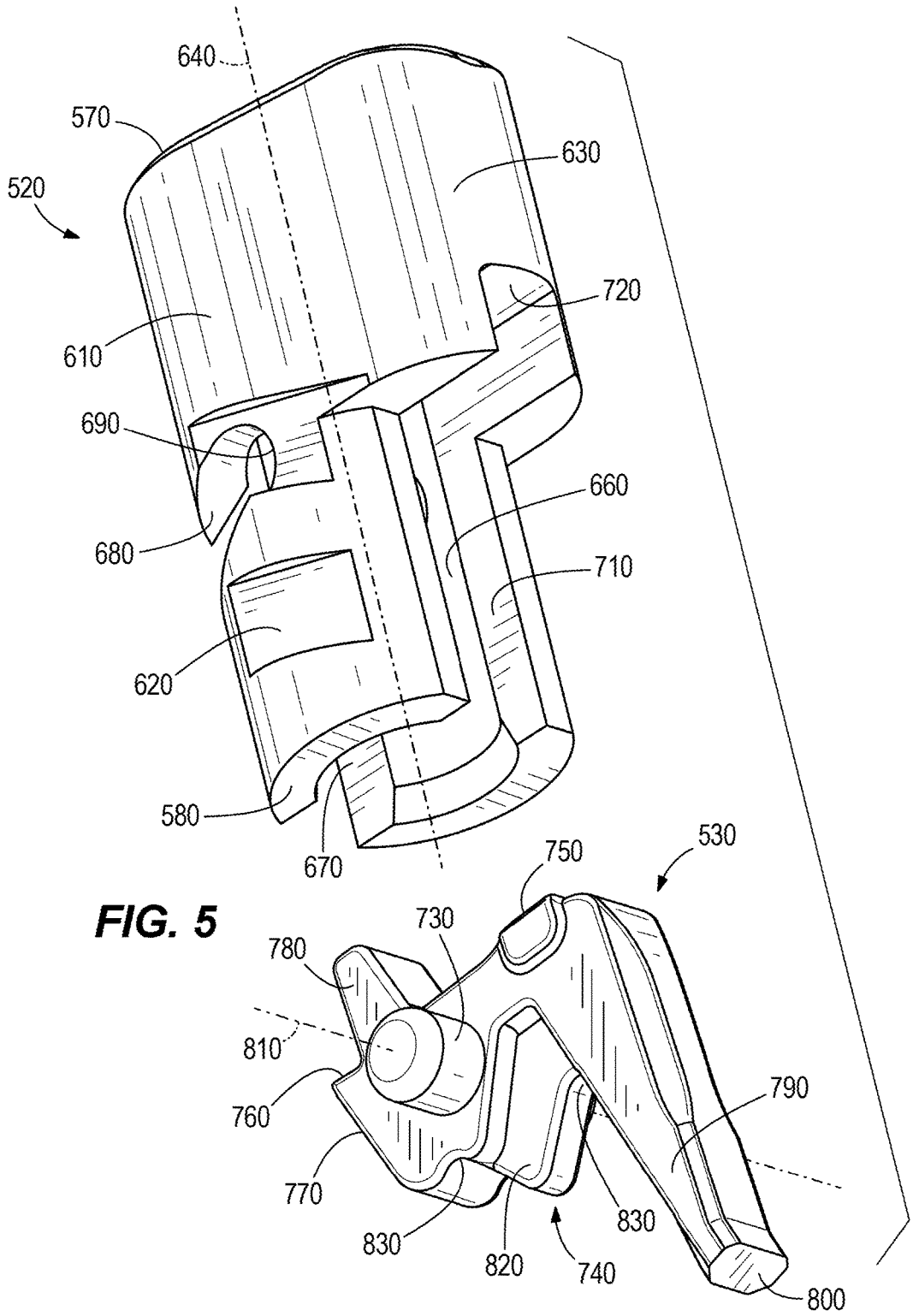
FIG. 5 is a perspective view of the button and pawl from a second angle.

Turning now to FIGS. 4 and 5, the button 520 includes a first end 570 and a second end 580 opposite the first end 570. The button 520 includes a head 610 and a sidewall 620. An outer surface 630 of the overall button 520 includes the outer surfaces of the head 610 and sidewall 620. The head 610 defines the first end 570 of the button 520 and the distal end of the sidewall 620 defines the second end 580 of the button 520.

The illustrated head 610 and sidewall 620 are integrally formed as a single component. The longitudinal extent of the button 520 defines a button axis 640 which is parallel to and collinear with the forward assist axis 270.

The head 610 includes an actuation surface 650 at the first end 570 of the button 520. To actuate the forward assist assembly 230, the operator of the firearm 100 applies a linear actuation force AF to the actuation surface 650 in line with the button axis 640. The operator may manually apply the linear actuation force AF with, for example, a thumb, finger, palm, or other suitable portion of the operator's body or another suitable surface or with a suitable tool. The actuation surface 650 may be planar or non-planar, and may include a contour, for example, to better fit the operator's thumb or finger.

The illustrated sidewall 620 extends parallel to the button axis 640 and generally perpendicular to the actuation surface 650 (or the best planar fit of the actuation surface 650 if it is not itself planar). The sidewall 620 defines a button bore 660 that is coaxial with the spring axis 540. The button bore 660 extends from the distal end 580 into the head 610, where it ends as a blind bore. The spring axis 540 is parallel to but not collinear with the button axis 640. In other embodiments, the spring axis 540 and button axis 640 can be collinear.

Figure 8:
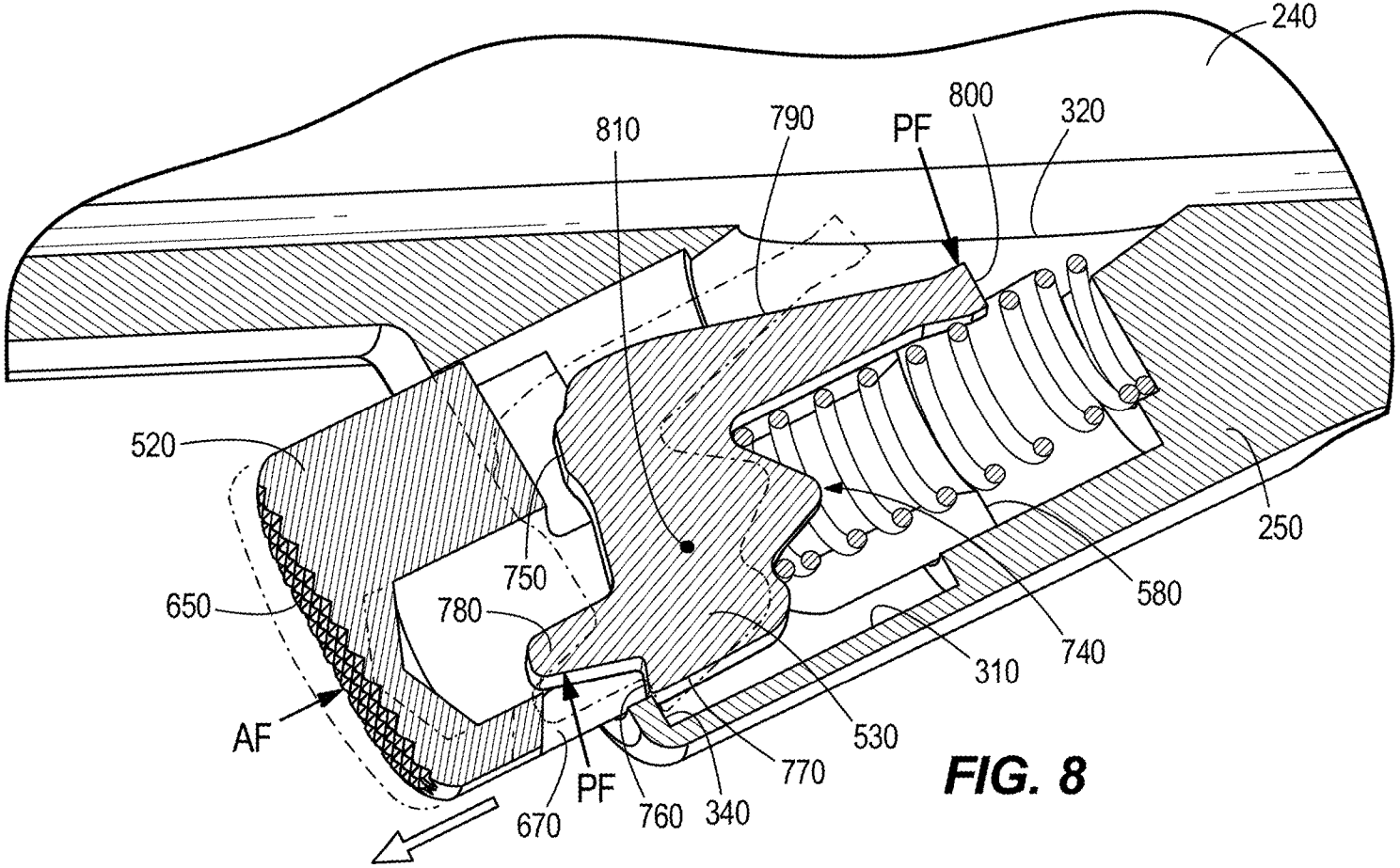
FIG. 8 is a cross-section view of a process for removing the forward assist assembly from the upper receiver housing.
Figure 9:
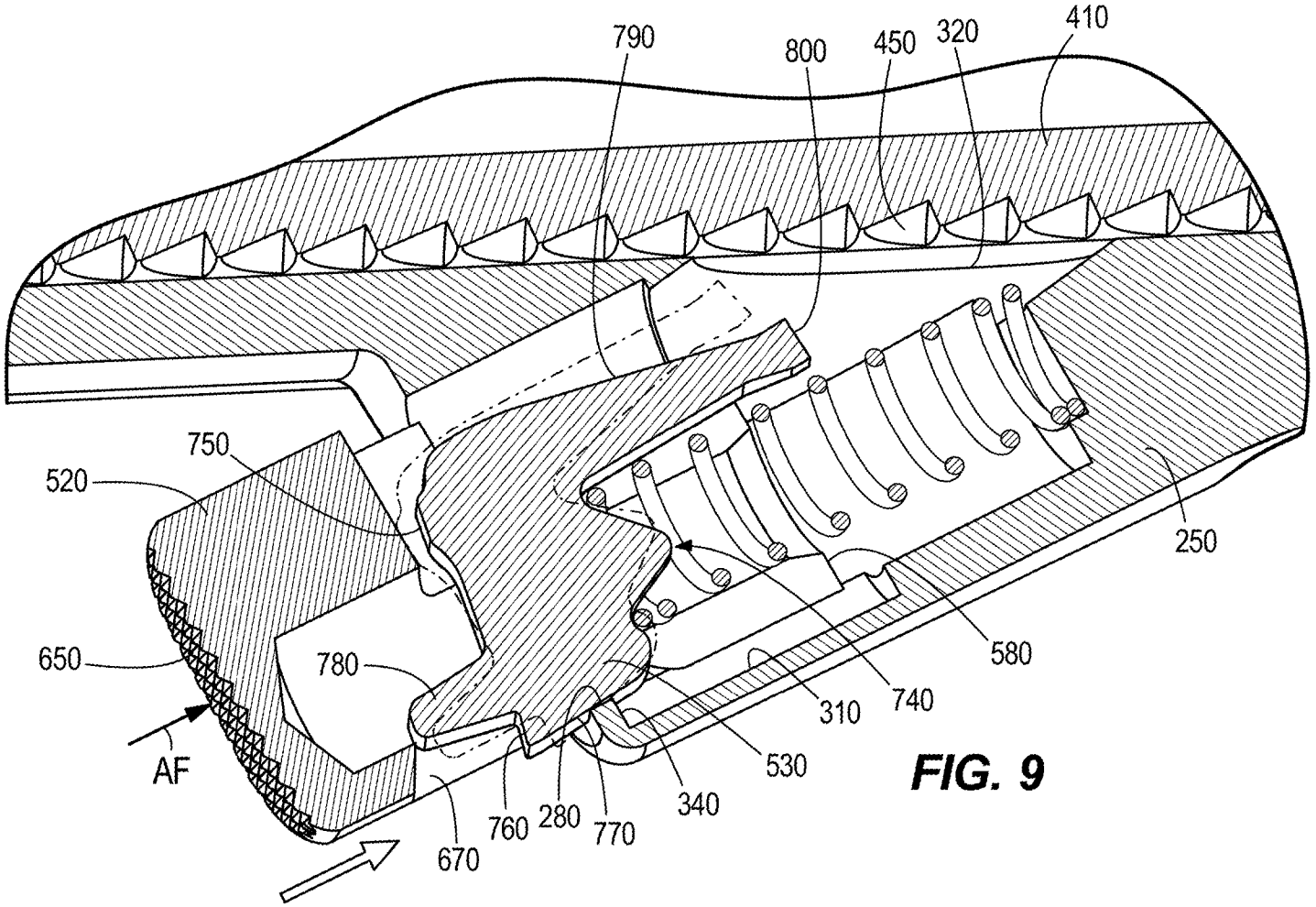
FIG. 9 is a cross-section view of a process for inserting the forward assist assembly into the upper receiver housing.

As illustrated in FIG. 4, a release slot 670 is formed into an outward side of the button 520, extending parallel to the button axis 640 from the distal end 580 and into the head 610. The term "outward side" means the side that faces away from the chamber 240. In other configurations, the release slot 670 could be provided in the lower or upper sides of the button 520 as long as the pawl 530 can be accessed by the operator through the release slot 670 to remove the forward assist assembly 230 from the forward assist bore 250 as described below. In any event, as illustrated in FIGS. 8 and 9, the release slot 670 aligns with the clearance section 310 of the forward assist bore 250. Referring back to FIG. 4, the release slot 670 communicates through the sidewall 620 between the outer surface 630 of the button 520 and the button bore 660. A pivot slot 680 is integrally-formed into the same side of the button 520 as the release slot 670 (i.e., the outward side in the illustrated embodiment). The pivot slot 680 is an open channel in the button 520, opening through the sidewall 620. The pivot slot 680 extends transverse to and across the release slot 670, providing U-shaped pivot seats 690 in the sidewall on opposite sides of the release slot 670. The pivot seats 690 open at an acute angle (e.g. in the range of about 40-50° or 20-70°) generally toward the distal end 580 with respect to the button axis 640. The button 520 is therefore adapted for linear reciprocation along the button axis 640 within the forward assist bore 250 and includes an integrally-formed pivot seat 690.

Referring now to FIG. 5, an engagement slot 710 is provided on the inward side (i.e., the side facing the chamber 240) of the button 520, extending parallel to the button axis 640 from the distal end 580 to the head 610, but not as deep into the head 610 as the release slot 670. The engagement slot 710 communicates through the sidewall 620 between the outer surface 630 of the button 520 and the button bore 660. The button 520 also includes a pawl bearing surface 720 or undercut surface under the head 610, extending perpendicular to the button axis 640 and facing toward the distal end 580. The engagement slot 710 is aligned with the access window 320 in the forward assist bore 250. In the illustrated embodiment, the release slot 670 and engagement slot 710 are aligned with each other (i.e., on opposite sides of the button axis 640, diametrically opposed across the button bore 660) and are about the same width such that the pawl 530 extends straight across the button bore 660, transversely through the button 520.

The button is dimensioned to fit within the forward assist bore 250 with the outer surface 630 of the button 520 in contact with the guide surfaces 300 of the forward assist bore 250. The outer surface 630 of the button 520 is smooth and the material of the button 520 is preferably a low-friction material to facilitate reliable reciprocation and smooth linear-reciprocating action of the button 520 in the forward assist bore 250. The button bore 660 is dimensioned to receive the return spring 510 such that the return spring 510 cannot significantly move perpendicular to the button bore 660. This results in biasing forces of the return spring 510 being substantially entirely directed parallel to the button axis 640 and forward assist axis 270 during operation.

With continued reference to FIGS. 4 and 5, the illustrated pawl 530 is a single piece component that includes a pair of pivot bosses 730 extending in opposite directions, a biasing member seat 740, a stop surface 750, a retaining surface 760, an insertion cam surface 770, a release lever 780, and a finger 790 having an engagement surface 800. All of the foregoing features are integrally-formed in the single-piece pawl 530.

The pivot bosses 730 are generally cylindrical shaped and are axially aligned with each other and define a pivot axis 810. The pivot bosses 730 are received in the pivot slot 680 and bear against the pivot seats 690. During operation, the pivot bosses 730 pivot in the pivot seats 690 about the pivot axis 810. The pivot axis 810 is perpendicular to the button axis 640, spring axis 540, and forward assist axis 270. The pivot slot 680 extends radially into the button 520 such that the pivot seats 690 are close to the spring axis 540 when assembled. As a result, the biasing force of the return spring 510 acts along a line offset a small amount from the pivot axis 810. The pivot bosses 730 are not at a geometric center of the pawl 530. In this regard, the pivot axis 810 may be termed a transverse eccentric pivot axis of the pawl 530. The pivot bosses 730 are axially aligned with each other in the illustrated embodiment, but could be offset from each other if the pivot seats 690 are properly positioned for the arrangement. Although the pivot bosses 730 in the illustrated embodiment are integrally formed with the rest of the pawl 530, the pivot bosses 730 could alternatively be provided by a dowel pin or roll pin extending through a hole in the pawl 530. Such alternative construction of the pivot bosses 730 is within the scope of the present invention. Any reference to pivot bosses in the description and claims of this specification should be interpreted to include both integral pivot bosses and a separate pin (e.g., a dowel pin or roll pin provided separate from the pawl 530), unless the pivot bosses are specifically characterized as integrally-formed with or separate from the pawl 530.

The biasing member seat 740 is defined by a raised portion 820 and a pair of grooves 830 at a base of the raised portion 820. When the forward assist assembly 230 is assembled and installed, the second end 560 of the return spring 510 abuts against the grooves 830 and receives the raised portion 820 of the biasing member seat 740. The biasing member seat 740 prevents the second end 560 of the return spring 510 from wandering with respect to the pawl 530.

Figure 6:
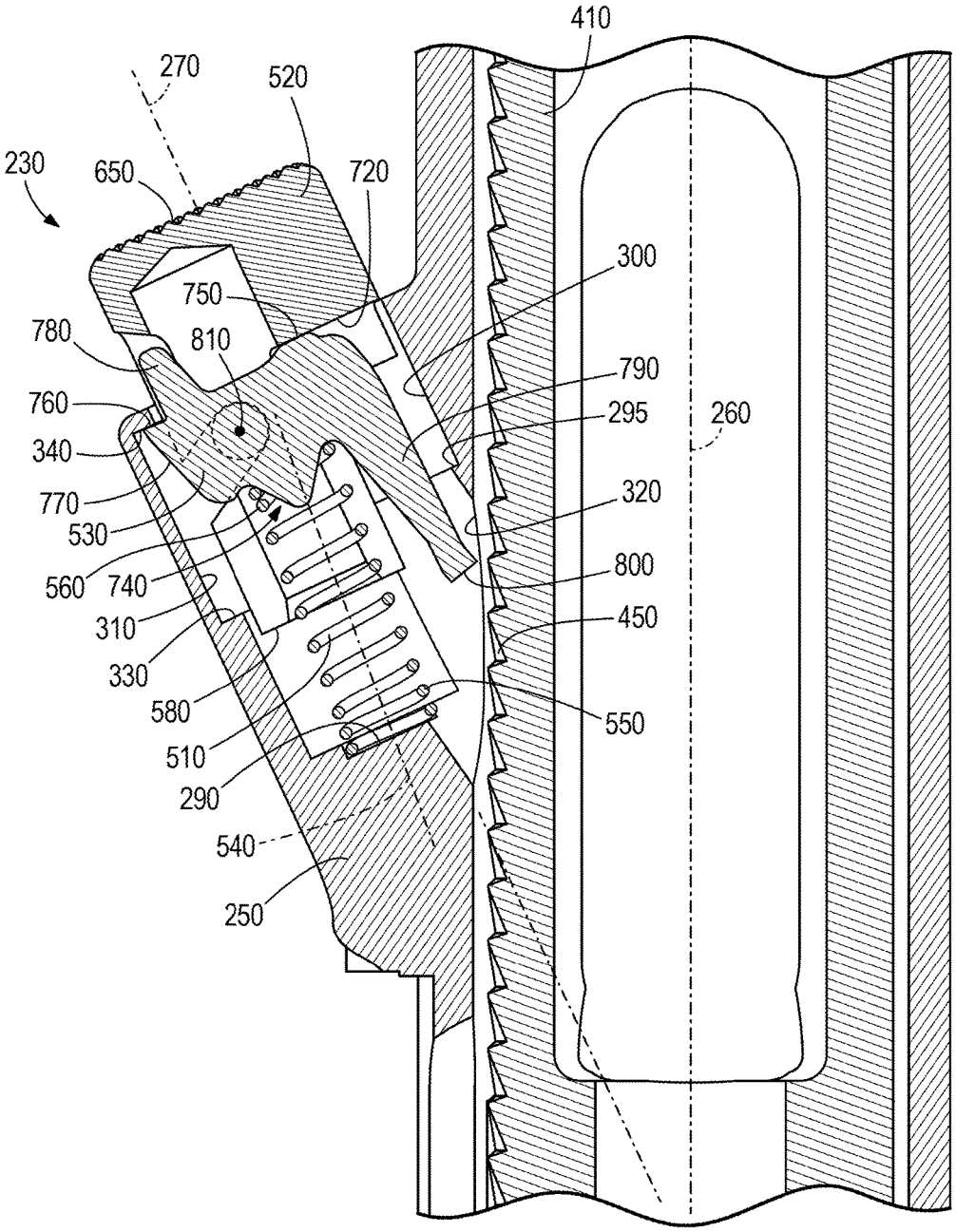
FIG. 6 is a cross-sectional view from section line 6-6 in FIG. 1 of the upper receiver assembly with the forward assist assembly in a standby position.
Figure 7:
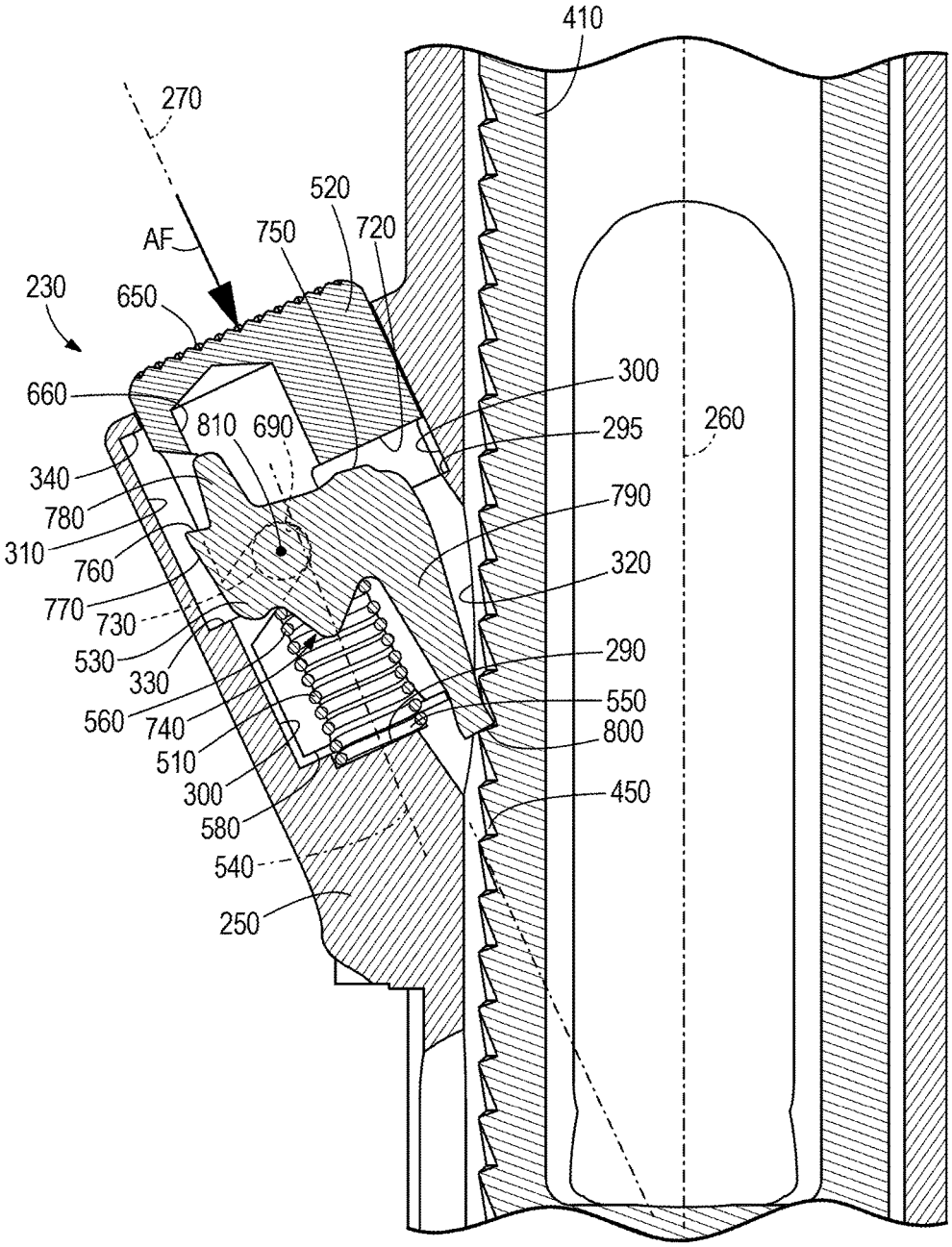
FIG. 7 is a cross-sectional view of the upper receiver assembly with the forward assist assembly in an engaged position.

With additional reference to FIG. 6, the stop surface 750 abuts the pawl bearing surface 720 of the button 520 to limit pivoting of the pawl 530 past the standby position. To facilitate manufacturing the pawl 530 by casting, the stop surface 750 is a relatively small pad raised with respect to the surrounding portions of the pawl 530. The retaining surface 760 is a planar surface that extends out of the release slot 670 of the button 520, perpendicular to the button axis 640, when the pawl 530 is in the standby position. The insertion cam surface 770 includes an inclined surface below the retaining surface 760, the significance of which will be discussed below. The release lever 780 is within the release slot 670 when the pawl 530 is in the standby position, such that the release lever 780 does not extend outside of the envelope of the button 520. The "envelope of the button" is used to describe the space within the outer surface 630 of the button 520. The finger 790 extends through the engagement slot 710 and into the access window 320. The engagement surface 800 is proximate to but spaced from the ratchet teeth 450 on the side of the bolt carrier 410 when the pawl 530 is in the standby position, and the engagement surface 800 engages one of the ratchet teeth 450 when the pawl 530 is moved into the engaged position.

Operation of the forward assist assembly 230 will now be described with reference to FIGS. 6 and 7. In the standby position (FIG. 6), the return spring 510 is captured between the biasing member bearing surface 290 at the first end 550 and the biasing member seat 740 at the second end 560. The return spring 510 is at least slightly deflected, which gives rise to a biasing force along the spring axis 540. The biasing force biases the pawl 530 and button 520 away from the biasing member bearing surface 290. The biasing force is applied on a line offset from and transverse to the pivot axis 810, which gives rise to a counterclockwise moment about the pivot axis 810 from the view of FIGS. 6 and 7. This moment brings the stop surface 750 of the pawl 530 into abutment with the pawl bearing surface 720 of the button 520. As noted above, the retaining surface 760 of the pawl 530 extends out of the release slot 670 in the standby position. The retaining surface 760 engages the retention undercut 340 at the mouth 280 of the forward assist bore 250. The return spring 510 therefore serves two functions: linearly returning the button 520 and pawl 530 to the standby position and pivoting the pawl 530 into the standby position. The forward assist assembly 230 is thus held in the standby position until an outside force is applied.

With reference to FIG. 7, the operator moves the forward assist assembly 230 toward the engaged position by applying a linear actuation force AF to the actuation surface 650 of the button 520. When the linear actuation force AF is sufficient to overcome the biasing force of the return spring 510, the button 520 and pawl 530 move linearly into the forward assist bore 250 and the return spring 510 is compressed. As the forward assist assembly 230 moves into the engaged position, the engagement surface 800 of the finger 790 of the pawl 530 engages the ratchet tooth 450 with which it is aligned. Continued linear movement of the forward assist assembly 230 toward the engaged position transfers at least a component of the linear actuation force AF through the button 520, the pivot bosses 730, and the finger 790 to the bolt carrier 410 to urge or move the bolt carrier group 220 forward in the chamber 240. Therefore, the linear actuation force AF applied to the button 520 is transferred to the pawl 530 through the engagement of the pivot seats 690 and pivot bosses 730. The pivot bosses 730 and U-shaped pivot seats 690 are therefore in the load path from the button 520 to the pawl 530 to the bolt carrier 410, and carry the linear actuation force AF perpendicular to the pivot axis 810 as they pivot in the pivot seats 690.

As the bolt carrier group 220 moves forward, the pawl 530 naturally rotates clockwise (as illustrated) on the pivot axis 810 to maintain the engagement surface 800 in contact with the ratchet tooth 450. This clockwise pivoting action moves the retaining surface 760 into the release slot 670, within the envelope of the button 520 so there is no interference with the shoulder 330 at the transition between the guide surface 300 and the clearance section 310 (i.e., the retaining surface 760 is pivoted out of the clearance section 310 into the envelope of the button 520). The button 520 and pawl 530 will continue moving toward the engaged position until: (1) the linear actuation force AF on the button is discontinued; (2) the linear actuation force AF is no longer sufficient to overcome the resistance afforded by the return spring 510 and bolt carrier group 220; (3) the distal end 620 of the button 520 bottoms out on the button stop 295; or (4) the bolt carrier group 220 reaches the ready-to-fire position. When the linear actuation force AF is discontinued, the return spring 510 pivots the pawl 530 back into the standby position in the button 520 and linearly moves the button 520 back to the standby position.

FIGS. 8 and 9 illustrate a method of removing the forward assist assembly 230 from the forward assist bore 250. An operator applies a linear pivoting force PF on the release lever 780 through the release slot 670 with a fingernail, tool or bullet head that is thin and strong enough for this purpose. Pushing the release lever 780 causes clockwise rotation of the pawl 530 about the pivot axis 810, as illustrated, into a release position. Alternatively or additionally, the operator may apply the linear pivoting force PF to the finger 790 from inside the chamber 240. To assist free rotation of the pawl 530, the operator may apply the linear actuation force AF to the button 520 to give the retaining surface 760 clearance past the retention undercut 340. The finger 290 simultaneously pivots into the envelope of the button 520 through engagement slot 710. Once the pawl 530 has pivoted into the release position, the entire pawl 530 is within the envelope of the button 520, and the forward assist assembly 230 can be removed through the mouth 280 of the forward assist bore 250.

The forward assist assembly 230 can be installed by reversing the process. First the pawl 530 is pivoted into the release position, then the forward assist assembly 230 is inserted into the forward assist bore 250, and then the release lever 780 is released to permit the pawl 530 to pivot counterclockwise and move linearly into the standby position.

Alternatively, with reference to FIG. 9, the return spring 510 can be dropped into the forward assist bore 250 and then the button 520 and pawl 530 can be positioned partially in the mouth 280 forward assist bore 250 with the insertion cam 770 surface engaging the mouth 280 of the forward assist bore 250. A linear actuation force AF applied to the engagement surface 650 of the button 520 will cause the pawl 530 to pivot clockwise due to the camming action of the cam surface 770 against the mouth 280 as the button 520 and pawl 530 advance into the forward assist bore 250. Once the cam surface 770 clears the mouth 280, the biasing force of the return spring 510 will cause the pawl 530 to pivot counterclockwise into the standby position. Releasing the linear actuation force AF on the button 520 will then permit the return spring 510 to move the button 520 and pawl 530 linearly to bring the retaining surface 760 into engagement with the retention undercut 340 as illustrated in FIG. 6.

Thus, the invention provides, among other things, a forward assist assembly that includes a single-piece pawl providing a pivot axis, a biasing member seat, and an engagement surface for engaging the ratchet teeth of the bolt carrier. Various features and advantages of the invention are set forth in the following claims.

What is claimed is:

1. A forward assist assembly for use with an upper receiver assembly of a firearm, the upper receiver assembly including a chamber, a forward assist bore communicating with the chamber, and a bolt carrier group within the chamber, the bolt carrier group including a bolt carrier having at least one external ratchet tooth accessible through the forward assist bore, the forward assist assembly adapted to be received in the forward assist bore and comprising:

a button having an integrally-formed pivot seat;

a single-piece pawl including an integrally-formed engagement surface; and a pivot boss received in the pivot seat and supporting the pawl, the pivot boss defining a pivot axis about which the pawl pivots with respect to the button;

wherein linear actuation of the button in the forward assist bore is transferred to the pawl through the interaction of the pivot seat and pivot boss to bring the engagement surface into engagement with the ratchet tooth; and wherein continued linear actuation of the button, after engagement of the ratchet tooth, urges the bolt carrier in a forward direction in the chamber as the pawl pivots about the pivot axis, to maintain engagement of the engagement surface with the ratchet tooth.

2. The forward assist assembly of claim 1, wherein the pivot seat comprises an open channel in the button.

3. The forward assist assembly of claim 1, wherein the pivot boss is integrally formed with the pawl.

4. The forward assist assembly of claim 1, wherein the pivot boss is defined by a pin extending through the pawl.

5. The forward assist assembly of claim 1, wherein the single-piece pawl further includes an integrally-formed biasing seat, the forward assist assembly further comprising: a biasing member bearing against the biasing seat to apply a biasing force to the button and pawl toward a standby position in the forward assist bore.

6. The forward assist assembly of claim 5, wherein the biasing force acts on a line offset from and transverse to the pivot axis to impart a moment to the pawl about the pivot axis with respect to the button.

7. The forward assist assembly of claim 5, wherein the biasing member includes a compression spring having a spring coil; and the integrally-formed biasing seat comprises a raised portion extending into the spring coil.

8. The forward assist assembly of claim 1, wherein the single-piece pawl further includes an integrally-formed stop surface which engages a pawl bearing surface of the button to limit a pivoting range of motion of the pawl with respect to the button.

9. The forward assist assembly of claim 1, wherein the single-piece pawl further includes an integrally-formed retaining surface engaging a portion of the forward assist bore to resist removal of the forward assist assembly from the forward assist bore.

10. The forward assist assembly of claim 9, wherein the single-piece pawl further includes a release lever for manually pivoting the pawl entirely within the envelope of the button for removal of the forward assist assembly from the forward assist bore.

11. The forward assist assembly of claim 1, wherein:

the button includes a release slot and an engagement slot;

the single-piece pawl includes an integrally-formed release lever extending through the release slot and an integrally-formed finger extending through the engagement slot and defining the engagement surface; and the pawl is pivotable with respect to the button about the pivot axis to position both the release lever and finger within the envelope of the button to facilitate removal of the forward assist assembly from the forward assist bore.

12. The forward assist assembly of claim 11, wherein the button includes a button bore and wherein the release slot and engagement slot are on opposite sides of the button bore.

13. An upper receiver assembly for a firearm, the upper receiver assembly comprising:

an upper receiver defining a chamber and a forward assist bore communicating with the chamber;

a bolt carrier group within the chamber, the bolt carrier group including a bolt carrier having at least one external ratchet tooth accessible through the forward assist bore; and a forward assist assembly within the forward assist bore and comprising a button having an integrally-formed pivot seat and a single-piece pawl including an integrally-formed engagement surface;

a pivot boss received in the pivot seat and supporting the pawl, the pivot boss defining a pivot axis about which the pawl pivots with respect to the button;

wherein linear actuation of the button in the forward assist bore is transferred to the pawl through the interaction of the pivot seat and pivot boss to bring the engagement surface into engagement with the ratchet tooth; and wherein continued linear actuation of the button, after engagement of the ratchet tooth, urges the bolt carrier in a forward direction in the chamber as the pawl pivots about the pivot axis, to maintain engagement of the engagement surface with the ratchet tooth.

14. The upper receiver assembly of claim 13, wherein the pivot seat comprises an open channel in the button.

15. The upper receiver assembly of claim 13, wherein the pivot boss is integrally formed with the pawl.

16. The forward assist assembly of claim 13, wherein the pivot boss is defined by a pin extending through the pawl.

17. The upper receiver assembly of claim 13, wherein the single-piece pawl further includes an integrally-formed biasing seat, the forward assist assembly further comprising: a biasing member bearing against the biasing seat to apply a biasing force to the button and pawl toward a standby position in the forward assist bore.

18. The upper receiver assembly of claim 17, wherein the biasing force acts on a line offset from and transverse to the pivot axis to impart a moment to the pawl about the pivot axis with respect to the button.

19. The upper receiver assembly of claim 17, wherein the biasing member includes a compression spring having a spring coil; and the integrally-formed biasing seat comprises a raised portion extending into the spring coil.

20. The upper receiver assembly of claim 13, wherein the single-piece pawl further includes an integrally-formed stop surface which engages a pawl bearing surface of the button to limit a pivoting range of motion of the pawl with respect to the button.

21. The upper receiver assembly of claim 13, wherein the single-piece pawl further includes an integrally-formed retaining surface engaging a portion of the forward assist bore to resist removal of the forward assist assembly from the forward assist bore.

22. The upper receiver assembly of claim 21, wherein the single-piece pawl further includes a release lever for manually pivoting the pawl entirely within the envelope of the button for removal of the forward assist assembly from the forward assist bore.

23. The upper receiver assembly of claim 13, wherein:

the button includes a release slot and an engagement slot;

the single-piece pawl includes an integrally-formed release lever extending through the release slot and an integrally-formed finger extending through the engagement slot and defining the engagement surface; and the pawl is pivotable with respect to the button about the pivot axis to position both the release lever and finger within the envelope of the button to facilitate removal of the forward assist assembly from the forward assist bore.

* * * * *